US005344863A

United States Patent [19]

Sakai et al.

[11] Patent Number: 5,344,863

[45] Date of Patent: Sep. 6, 1994

[54] VISCOSITY INDEX IMPROVER

[75] Inventors: Kouzou Sakai, Oumihachiman; Shigeyuki Yoshida; Makoto Dakurige, both of Kyoto, all of Japan

[73] Assignee: Sanyo Chemical Industries, Ltd., Kyoto, Japan

[21] Appl. No.: 897,036

[22] Filed: Jun. 11, 1992

[30] Foreign Application Priority Data

Jul. 5, 1991 [JP] Japan ..... 3-192578

[51] Int. Cl.[5] ..... C08K 5/09

[52] U.S. Cl. ..... 524/291; 524/352; 524/353

[58] Field of Search ..... 524/291, 352, 353

[56] References Cited

U.S. PATENT DOCUMENTS 4,603,189 7/1986 Ishii ..... 524/291

4,665,121 5/1987 Pennewiss et al. .

4,677,151 6/1987 Pennewiss et al. .

*Primary Examiner*—Joseph L. Schofer

*Assistant Examiner*—Peter D. Mulcahy

*Attorney, Agent, or Firm*—Oblon, Spivak, McClelland, Maier & Neustadt

[57] ABSTRACT

A viscosity index improver which contains a polymer dispersion comprising: a polyolefin having a weight average molecular weight of 10,000 to 500,000, a dispersant comprising a reaction product of an ethylenically unsaturated dicarboxylic acid added polyolefin with a carboxylic acid-reactive compound selected from the group consisting of an amine, a ketimine compound, an alcohol and an isocyanate compound and an organic liquid medium comprising a liquid phenolic derivative selected from the group consisiting of an alkyl phenol and an alkyl salicylate.

19 Claims, No Drawings

VISCOSITY INDEX IMPROVER

BACKGROUND OF THE INVENTION

The present invention relates to a viscosity index improver. In particular, the present invention relates to a non-aqueous and concentrated polymer dispersion in a carrier medium which has characteristics of stability, low viscosity and resistance to oxidation.

Hitherto, a polyolefin-based viscosity index improver has widely been used on an engine oil because of its characteristic of having a good thickening action. The viscosity index improver of the type is distributed as a commercial product in the form of a solution comprising about 10 to 20% by weight of a polyolefin and about 90 to 80% by weight of a mineral oil. When a polyolefin content in the improver is increased more than the said range, the improver could not be in practical use because of its much troublesome handlability. Therefore, there is a demand that the improver has a high content of polyolefin, but a low viscosity.

In order to satisfy the demand, some improvers have been proposed. For instance, Japanese Patent Laid-open No. 171417/83 discloses a non-aqueous and concentrated polymer dispersion comprising a polyolefin, a graft or block polyolefin of a (meth)acrylate as a dispersant and a carrier medium which does not substantially dissolve the polyolefin. Also, Japanease Patent Laid-open No. 171418/83 discloses a non-aqueous and concentrated polymer dispersion comprising a polyolefin, a graft or block polyolefin of a vinyl monomer which is not of the (meth)acrylate as a dispersant and a carrier medium which doese not substantially dissolve the polyolefin. Furthermore, Japanease Patent Laid-open No. 37296/91, discloses a non-aqueous and concentrated polymer dispersion comprising a polyolefin, a reaction product of a maleic acid-grafted polyolefin with an alcohol, a carboxylic acid or a polyisocyanate and the like as a dispersant and a medium which doese not substantially dissolve the polyolefin.

The above improvers do not satisfy the resistance to oxidation which will be forecasted to become an important function of a lubricating oil in the near future.

SUMMARY OF THE INVENTION

An object of the present invention is to provide a viscosity index improver comprising a stable, concentrated and non-aqueous polymer dispersion having a low viscosity, which has improved resistance to oxidation and improved engine sludge control, especially suitable for a lubricating oil such as an engine oil.

The object of the present invention can be achieved by a viscosity index improver containing a polymer dispersion comprising:

a polyolefin having a weight average molecular weight of 10,000 to 500,000, a dispersant comprising a reaction product of an ethylenically unsaturated dicarboxylic acid-added polyolefin with a carboxylic acid-reactive compound selected from the group consisting of an amine, a ketimine compound, an alcohol and an isocyanate compound, said reaction product having an amide linkage, an imide linkage or an ester linkage and an organic liquid medium containing a liquid phenolic derivative selected from the group consisting of an alkyl phenol and an alkyl salicylate, which does not substantially dissolve the polyolefin.

According to the present invention, a viscosity index improver having good resistance to oxidation and a good thickening action can be obtained by dispersing a polyolefin in a medium containing an alkyl phenol or an alkyl salicylate with help of a specific grafted polymer as a dispersant.

DETAILED DESCRIPTION OF THE INVENTION

The polyolefin used in the present invention includes a polymer or copolymer of an olefin such as ethylene, propylene, isobutylene, butadiene, isoprene and the like. It also includes a copolymer of these olefin and styrene, cyclopentadiene, dicyclopentadiene or ethylidenenorbornene and the like and a hydrogenated product of these copolymers. Furthermore it includes a degradated product of the above polymers or above copolymers by oxidation or thermolysis.

In addition, it includes a modified polymer such as a polyolefin having a basic nitrogen, oxygen and/or sulfur atoms. The content of these atom is usually 0.01 to 10% by weight, preferably 0.5 to 6% by weight, more preferably 0.5 to 3% by weight based on the polymer. The basic nitrogen atom-containing polyolefin is exemplified by a reaction product of a polyolefin added or grafted with maleic acid or its anhydride with an amine. It also is exemplified by a condensate of an oxidized polyolefin with formaldehyde and polyamine and a graft polyolefin of a basic nitrogen atom-containing vinyl monomer such as N-vinylpyrolidone, N-vinylthiopyrolidone, dialkylaminoethyl(meth)acrylate, N-vinylimidazole and the like or a heterocyclic compound such as phenotiazines, imidazoles, thiazolse, benzothiazoles, triazoles, thiazolidines, pyrimidines, pyridines, pipelidines, pyrolidines, oxazoles, thiomorpholines and the like.

Among them, the ethylene-propylene copolymer is preferably used because of an excellent improvement of viscosity index and good stability of viscosity under the conditions of high temperature and high shear (so called "HTHS" viscosity). The basic nitrogen atom-containing ethylene-propylene copolymer is more preferable because it has a good control of engine vanish and engine sludge.

The polyolefin used in the present invention has a preferable weight average molecular weight of 20,000 to 300,000 in view of the high viscosity index, the thickening action and the shear stability.

The polyolefin used to obtain the dispersant (the reaction product) in the present invention includes the polymers or copolymers of the before-mentioned olefin and the degradated product thereof. It is preferable that the polyolefin, which is a backbone of the unsaturated dicarboxylic acid-added polyolefin, is a polymer of the same as a monomer unit constituting the polyolefin. Ethylene-propylene copolymers are particularly suitable for use. The weight average molecular weight of the polyolefin is usually 3,000 to 500,000, preferably 10,000 to 300,000.

The unsaturated dicarboxylic acid in the invention is, for example, maleic acid, itaconic acid, fumaric acid and chloromaleic acid. The ethylenically unsaturated dicarboxylic acid used to obtain the dispersant (the reaction product) in the present invention includes ethylenically unsaturated monomer having a functional group such as an ester group, an acid anhydride group, an aldehyde group, an acid halide, an amide group and the like, capable of being transferred to carboxylic acid group.

The monomer having the carboxylic acid group-transferable functional group is, for example, an acid halide such as maleic dichloride, fumaric dichloride, an ester such as monobutyl maleate, an amide such as monobutyl maleate amide and an anhydride such as maleic acid anhydride, itaconic acid anhydride, chloromaleic acid anhydride and the like.

The amount of the unsaturated dicarboxylic acid added to the polyolefin is usually 1 to 300 moles, preferably 5 to 150 moles per one mole of the polyolefin.

The unsaturated dicarboxylic acid-added polyolefin can be obtained by reacting the polyolefin with the unsaturated dicarboxylic acid in the presence or in the absence of a radical initiater as described in U.S. Pat. No. 3,326,917. For example, it can be produced by adding the unsaturated dicarboxylic acid on to the polyolefin in the presence of an peroxide such as dicumylperoxide. It can be also produced by ene-reaction of the unsaturated dicarboxylic acid with an olefinic copolymer, for example a copolymer comprising cyclopentadiene as a comonomer.

The amine used in the present invention includes, for example, ammonia, an aliphatic monoamine such as ethylamine, butylamine, hexylamine, octylamine, nonylamine, decylamine, tridecylamine, cetylamine, dimetylamine, diisopropylamine, diamylamine, cyclohexylamine, allylamine, diallylamine, a polyamine such as ethylenediamine, diethylenetriamine, triethylenetetramine, dialkylaminopropylamine, 1,4-diaminomethylcyclohexane, an alkanolamine such as monoethanolamine, monopropanolamine, an aromatic amine such as aniline, toluidine, benzylamine, diphenylamine, naphthylamine, a heterocyclic amine such as morpholine, imidazoline, N-aminoalkylpiperadine, tallow amine and coconut amine. It also includes polyoxyalkylene mono or polyamine obtained by adding an alkyleneoxide having 2 to 4 carbon atoms to the above amines. The polyoxyalkylene amine has usually a number average molecular weight of 1,000 to 4,000. The preferable amine is a propyleneoxide adduct of the above amines which has the molecular weight of 1,000 to 4,000.

The ketimine compound used in the present invention includes a condensate of an amine with a ketone. Such amine includes the above amines beforementioned. The preferable amine is an alkanolamine having a first amino group. It includes, for example, monoethanolamine and monopropanolamine. Such ketone includes, for example, acetone, methylethylketone, methybutylketone and cyclohexanone. An alkylene oxide adduct of the ketimine compound containing a hydroxy group, that is to say, polyalkylene mono or polyol having a ketimino group, can be also used. The polyoxyalkylene ketimine compound has usually the molecular weight of 1,000 to 4,000. The preferable compound is a propyleneoxide adduct of the above ketimine compound, which has the molecular weight of 1,000 to 4,000.

The alcohol used in the present invention includes an aliphatic monohydric alcohol such as methanol, butanol, isoamylalcohol, myristylalcohol, melissylalcohol, allylalcohol, propargylalcohol and cyclohexanol and an aliphatic polyol such as ethyleneglycol, propyleneglycol, 1,4-butanediol, 1,5-pentanediol, 1,10-decanediol, dipropyleneglycol, 3-methypentanediol, polyethyleneglycol, polypropyleneglycol, polytetramethyleneglycol, trimethylolpropane, glycerin, pentaerythrytol and the like. It also includes an alkyleneoxide adduct of the above alcohols and an alkyleneoxide adduct of mono- or dialkylphenols having alkyl group of 6 to 20 carbon atoms. The alkylene oxide has usually 2 to 4 carbon atoms. The alkyleneoxide adduct has usually a number average molecular weight of 1,000 to 4,000. The preferable is a propyleneoxide adduct of the above alcohols which has the molecular weight of 1,000 to 4,000. Furthermore, it includes an alkyleneoxide adduct of mono- or polycarboxylic acids having 1 to 30 carbon atoms. They may be saturated or unsaturated. They are, for example, acetic acid, propionic acid, hexanoic acid, octanoic acid, undecanoic acid, myristylic acid, eicosanoic acid, oleic acid, succinic acid, adipic acid, azeric acid, sebacic acid, phthalic acid, benzene tricarboxylic acid, citric acid and the like. In addition, an sulfate or sulfonate ester having a hydroxy group, for example, hydroxy polyethoxy alkyl benzene sulfonate, may be used.

The isocyanate compound used in the present invention includes an aliphatic isocyanate such as hexamethylenediisocyanate, lysinediisocyanate, dicyclohexylmethanediisocyanate, dicyclohexylmethanetriisocyanate, isophoronediisocyanate and the like, an aromatic isocyanate such as tolylene diisocyanate, diphenylmethanemonoisocyanate, diphenylmethanediisocyanate, diphenylmethanetriisocyanate, xylylenediisocyanate and the like. It also includes an isocyanate terminated prepolymer or an adduct obtained from those polyisocyanates and polyamine or polyolrespectively beforementioned. Further, the alkyleneoxide adduct of said prepolymer or said adduct may be used.

Partial reaction products of excess amount of amines, alcohols, ketimine compounds or isocyanate compounds respectively beforementioned with a carboxylic acid such as acetic acid, propionic acid, hexanoic acid, octanoic acid, capric acid, undecanoic acid, myristylic acid, eicosanoic acid, oleic acid, oxalic acid, succinic acid, adipic acid, azeraic acid, sebacic acid, phthalic acid, terephthalic acid and the like can be also used. Further, an alkyleneoxide having 2 to 4 carbon atoms adduct of the reaction product can be used. The reaction product of those compounds with the above acids, usually in which an equivalent ratio of the former to the latter is not less than 1.25, preferably not less than 2.

Among them, the partial reaction products having an ester group and alkylene oxide adduct of amines, alcohols, ketimine compounds and isocyanate compounds are preferable in view of dispersibility. The alkylene oxide adducts are more preferable. These have usually the molecular weight of 1,000 to about 4,000.

The weight ratio of the ethylenically unsaturated dicarboxylic acid-added polyolefin to the amine, the ketimine compound, the alcohol or the isocyanate compound in the dispersant is usually in the ratio of 20:80~80:20, preferably 40:60~70:30 in view of dispersibility or compatibility with a lubricating oil a mixture of which become cloudy with the viscosity index improver.

The dispersant in the present invention can be obtained by condensation reaction of the unsaturated dicarboxylic acid-added polyolefin with the amine, the ketimine compound, the alcohol or the isocyanate compound at the temperature ranged from room temperature to 200° C. The reaction can be carried out in the presence or in the absence of the known catalyst and distilable solvent such as hexane, heptane, toluene, xylene, diethylbenzene and low boiling-point paraffin, if necessary.

When the dispersant in the invention has a polar group such as a hydroxy group and an amino group, the viscosity index improver has in a particular case undesirable property. In such a case, said polar group of the dispersant is preferably blocked up with a monocarboxylic acid having not more than 31 of the total carbon atoms or monosulfonic acid compound having 6 to 40 carbon atoms.

The alkyl phenol in the present invention is usually monoalkyl phenol and dialkyl phenol. It has usually alkyl group of 1 to 20 carbon atoms, preferably 2 to 16 carbon atoms, more preferably 4 to 12 carbon atoms, which may be straight or branched. The position of the alkyl group is not limited. The phenol having such a carbon number is apt to give a low viscous and stable dispersion, because such phenols have a close specific gravity to the polyolefin, thus it is difficult to cause phase separation. Typical examples of the alkyl phenol are cresol, xylenol, carvacrol, thymol, isopropylphenol, sec-butylphenol, hexylphenol, octylphenol, nonylphenol, dodecylphenol, hexadecylphenol, octadecylphenol, di-sec-butylphenol and dihexylphenol. Among them, the alkyl phenol having the alkyl group of a total carbon number of 4 to 12 is more preferable.

The alkyl salicylate in the invention has usually alkyl group of 1 to 20 carbon atoms, which may be straight or branched.

Typical examples of the salicylate are methyl salicylate, propyl salicylate, butyl salicylate, amyl salicylate, octyl salicylate, decyl salicylate and hexadecyl salicylate. The salicylate having alkyl group of 4 to 10 carbon atoms is preferable because of giving a low viscous and stable dispersion.

The medium in the present invention may contain other medium, if it does not substantially dissolve the polyolefin. The other medium includes an alcohol having 6 or more carbon atoms, a mineral oil and a carboxylate ester derived from monocarboxylic acid or dicarboxylic acid and monohydric alcohol, diol, triol or tetraol. Typical examples of the monocarboxylic acid are acetic acid, propionic acid, hexanoic acid, octanoic acid, capric acid, undecanoic acid and myristylic acid. Typical examples of the dicarboxylic acid are succinic acid, adipic acid, azelaic acid, fumaric acid, sebacic acid, maleic acid, phthalic acid, isophthalic acid and terephthalic acid. Typical examples of monohydric alcohol are methanol, butanol, isoamyl alcohol, myristyl alcohol, melissyl alcohol, allylalcohol, propargylalcohol and cyclohexanol. Typical examples of the di-, tri- or tetrahydric alcohol are ethyleneglycol, propyleneglycol, 1,4-butanediol, 1,5-pentanediol, 1,10-decanediol, dipropyleneglycol, 3-methypentanediol, polyethyleneglycol, polypropyleneglycol, polytetramethyleneglycol, trimethylolpropane, glycerin, pentaerythrytol and polyetherpolyol obtained by adding an alkylene oxide having 2 to 4 of carbon atoms to those alcohols above-mentioned.

The alcohol having 6 or more carbon atoms includes monohydric alcohol such as 2-ethylhexyl alcohol, n-octyl alcohol, isooctyl alcohol and oxo-alcohol having 6 to 10 carbon atoms and polyhydric alcohol such as hexylene glycol, decamethylene glycol and pentaerythrytol. The medium in the present invention can also include an alkyleneoxide adduct of an active hydrogen-containing compound such as alcohol, amine, amide, carboxylic acid, phenol and the like. The alkyleneoxide has usually 2 to 4 carbon atoms. It is exemplified by ethyleneoxide, propyleneoxide and butyleneoxide. The carboxylic acid in said adduct is exemplified by citric acid and gluconic acid. The amide in said adduct is exemplified by acetamide, propionamide, octamide, oleamide, stearamide and N-methyl propionamide. The amine in said adduct is exemplified by morpholine. An amount of the alkyleneoxide added to an active hydrogen-containing compound is usually 1 to 50 moles, preferably 1 to 35 moles per 1 mole of the active hydrogen-containing compound. Among them, diesters derived from dicarboxylic acid and monohydric alcohol, di-, tri-and tetraesters derived from polyol and monocarboxylic acid are preferably. Diesters derived from succinic acid, adipic acid, phthalic acid, isophthalic acid or terephthalic acid and monohydric alcohol having 1 to 10 carbon atoms and from dihydric alcohol and monocarboxylic acid having 1 to 10 carbon atoms are more preferably. The alkylene oxide adduct of alkylphenol having (cyclo) alkyl group of not more than 20 carbon atoms can be also used. The alkyl group in the phenol may be straight or branched. The alkyleneoxide adduct of the alkyl phenol having the alkyl group of 6 to 12 carbon atoms is preferable.

The phthalate ester and the alkylene oxide adduct of the alkylphenol having the alkyl group of 6 to 12 carbon atoms are further more preferable.

The organic liquid medium in the present invention means liquid or fluid at the temperature up to about 35° C. The alkyl phenol or alkyl salicylate content in the medium is usually not less than 10% by weight, preferably not less than 30% by weight, more preferably not less than 40% by weight, based on the total weight of the medium.

The viscosity index improver according to the present invention comprises usually 10 to 70% by weight, preferably 30 to 60% by weight of the polyolefin having a weight average molecular weight of 10,000 to 500,000, usually 0.5 to 20% by weight, preferably 1 to 10% by weight of the dispersant, and usually 25 to 90% by weight, preferably 30 to 70% by weight of the organic liquid medium.

The polymer dispersion in the present invention can be prepared by adding an organic solvent solution of the polyolefin to a mixture of the dispersant and the medium while removing the solvent, if necessary, under the reduced pressure. It can be also prepared by adding a mixed solution of the polyolefin and the dispersant to the medium while removing the solvent, if necessary under the reduced pressure. The polyolefin-containing solution above-mentioned is usually added while taking 2 to 10 hours. If the solution is much rapidly added compared with removal speed of the solvent, the polyolefin would not be emulsified or dispersed. Gelling would be caused in the extremely worse case.

The solvent suited to dissolve the polyolefin is hexane, heptane, toluene, xylene, diethylbenzene and low boiling-point paraffin. The temperature to remove the solvent is usually in the range of 50° C. to 200° C. The higher temperature is not preferable because of decomposition of the polyolefin.

The viscosity index improver according to the invention may contain a pour point depressant and a stabilizing agent for extended storage thereof.

The depressant is, for example, poly(meth)acrylate and condensate of chlorinated paraffin with naphthalene. The preferable depressant is poly(meth)acrylate. The improver may contain at most 30% by weight of the depressant based on it.

The stabilizing agent is an aliphatic or an aromatic sulfonate salt having a total carbon number of 8 to 40 and an aliphatic or an aromatic monocarboxylate salt having a total carbon number of 6 to 31. It is, for example, calcium petroleum sulfonate, calcium mono-or dialkyl benzene sulfonate, calcium oleate and calcium octylate. The sulfonate is preferable. The improver may contain at most 20% by weight of the stabilizing agent based on the polyolefin.

the improver according to the present invention is applicable for the lubricating oil such as engine oil, gear oil and automatic transmission fluid. It is particularly preferable for engine oil.

Usually 0.5 to 10% by weight of the improver according to the present invention is added to the lubricating oil, whereupon it displays excellent functions of a viscosity index improvement, a thickening effect and an antioxidation effect.

Other additives such as detergent-dispersant, antioxidant, friction modifier, anticorrosion agent, anti-foaming agent and extreme pressure agent can be added to the oil with the improver in order to obtain the fine lubricating oil, if need.

Next, the present invention will be explained in more detail by way of the following examples, which, however, are not intended to restrict the scope of the present invention.

All "parts" and "%" are "parts by weight" and "% by weight" hereinunder, unless otherwise specifically indicated.

EXAMPLE 1

A 31.5% solution of a maleic acid-added ethylene-propylene copolymer was prepared by heating a mixture of 172 parts of ethylene-propylene copolymer having a weight average molecular weight of 150,000 and its propylene content of 50 weight %, 402 parts of normal paraffin having 10 carbon atoms, 0.6 parts of laurylmercaptan, 10.3 parts of maleic anhydride and 3.0 parts of dibutyl peroxide to the temperature of 110° C. under the nitrogen atomosphere while taking one hour, followed by heating it for 3 hours. The resulting solution of the copolymer was mixed with 320 parts of aminopolyether having molecular weight of 2030 (prepared by hydrolyzing propyleneoxide 34 moles adduct of ketimine compound derived from monoethanolamine and methyisobutylketone) and 333 parts of normal paraffin having 10 carbon atoms and heated up to the temperature of 130° C. After the mixture was heated at the same temperature for 12 hours while removing by-produced water, 34% concentrated solution of the dispersant in the invention was obtained.

A basic nitrogen atom-containing polyolefin in the invention was prepared by reacting 130 parts of ethylene-propylene copolymer having weight average molecular weight of 200,000 with 6.5 parts of dimethylaminoethyl methacrylate in normal paraffin having 10 carbon atoms in the presence of 0.4 parts of lauryl mercaptan and 2.0 parts of dicumyl peroxide under the nitrogen atomosphere at 130° C. for 2 hours. After the solution of the nitrogen atom-containing polyolefin was mixed with 150 parts of di-sec-butylphenol, 80 parts of the paraffin was distilled off under the reduced pressure of 10 to 5 mmHg. at 130° C., followed by mixing 39.4 parts of the beforementioned dispersant solution and total weight of the paraffin being distilled off under the reduced pressure at 130° C. While the thus obtained solution was stirred, a dispersion of the ethylene-propylene copolymer was obtained by gradually cooling to 40° C.

The viscosity of the dispersion at 20° C. is shown in TABLE 1. The 96 hour-resistance to oxidation of a mixture of a mineral oil (neutral oil No. 150) and 2 wt. % of the dispersion based on the oil, was evaluated in conformity with of JAPANEASE INDUSTRY STANDARD 2514, B method. The measured result is shown in TABLE 1.

EXAMPLE 2~6

Polymer dispersions were produced in the same manner as that of the EXAMPLE 1 except using thymol, diamylphenol, nonylphenol, butyl salicylate or octyl salicylate respectively in place of di-sec-butylphenol. Each viscosity of those dispersions at 20° C. is shown in TABLE 1. The resistance to oxidation was evaluated in the same manner as that of EXAMPLE 1.

EXAMPLE 7

A 31.1% solution of a maleic acid-added ethylene-propylene copolymer in paraffin was prepared by heating a mixture of 172 parts of ethylene-propylene copolymer having weight average molecular weight of 200,000 and its propylene content of 45% by weight, 402 parts of normal paraffin having 10 carbon atoms, 0.6 parts of laurylmercaptan, 6.9 parts of maleic anhydride and 3.0 parts of dibutyl peroxide to the temperature of 110° C. under the nitrogen atmosphere while taking one hour and further heating for 3 hours followed by adding 1.3 parts of water to change to maleic acid form. After removal of residual water in the resultant solution, 320 parts of a ketimino group-containing polypropylene alcohol having molecular weight of 3050 (prepared by adding 51 moles of propylene oxide to ketimine compound derived from monoethanolamine and methyisobutylketone) was mixed with the resulting solution and 333 parts of normal paraffin having 10 carbon atoms and heated up to the temperature of 130° C. After the mixture was heated at the same temperature for 7 hours while removing by-produced water, 37% concentrated solution of the dispersant in the invention was obtained.

A polymer dispersion were produced in the same manner as that of the EXAMPLE 1 except using the above dispersant in place of the dispersant of EXAMPLE 1. The viscosity of the dispersion at 20° C. was shown in TABLE 1. The resistance to oxidation is evaluated in the same manner as that of EXAMPLE 1.

EXAMPLE 8

A 32% solution of dispersant was produced by reacting 587 parts of the maleic acid-added ethylene-propylene copolymer solution of EXAMPLE 1 with 233 parts of propyleneoxide adduct of methanol having molecular weight of 1480 in the presence of 0.01 parts of tetrabutyl titanate in 333 parts of xylene at 130° C. for 15 hours while by-produced water was distilled off.

A polymer dispersion was produced in the same manner as that of the EXAMPLE 1 except using the thus obtained dispersant in place of the dispersant of EXAMPLE 1. The viscosity of the dispersion at 20° C. was shown in TABLE 1. The resistance to oxidation is evaluated in the same manner as that of EXAMPLE 1.

EXAMPLE 9

A 29% solution of dispersant was produced by reacting 587 parts of the maleic acid-added ethylene-propylene copolymer solution of EXAMPLE 1 with 153 parts of the equal equivalent-reactant product of ethyleneoxide adduct of morpholine having molecular weight of 970 and hexamethylenediisocyanate whose molecular weight is 1130, in xylene at 120° C. for 10 hours.

A polymer dispersion was produced in the same manner as that of the EXAMPLE 1 except using the thus obtained dispersant in place of the dispersant of EXAMPLE 1. The viscosity of the dispersion at 20° C. was shown in TABLE 1. The resistance to oxidation is evaluated in the same manner as that of EXAMPLE 1.

EXAMPLE 10

A 34% solution of dispersant was produced by reacting 587 parts of the maleic acid-added ethylene-propylene copolymer solution of EXAMPLE 1 with 284 parts of polyester (obtained by condensating polytetramethyleneglycol having molecular weight of 510 and phthalic acid in equivalent ratio of 3 to 2) in the presence of 0.02 parts of tetrabutyl titanate in 333 parts of xylene at 150° C. for 13 hours.

A polymer dispersion was produced in the same manner as that of the EXAMPLE 1 except using the thus obtained dispersant in place of the dispersant of EXAMPLE 1. The viscosity of the dispersion at 20° C. was shown in TABLE 1. The resistance to oxidation is evaluated in the same manner as that of EXAMPLE 1.

EXAMPLE 11

A 31% solution of dispersant was produced by reacting 587 parts of the maleic acid-added ethylene-propylene copolymer solution of EXAMPLE 1 with 199 parts of polyester having molecular weight of 1260 (obtained by condensating triethyleneglycol and adipic acid in equivalent ratio of 5 to 4) in the presence of 0.02 parts of tetrabutyl titanate in 333 parts of xylene at 150° C. for 13 hours.

A polymer dispersion was produced in the same manner as that of the EXAMPLE 1 except using the thus obtained dispersant in place of the dispersant of EXAMPLE 1. The viscosity of the dispersion at 20° C. was shown in TABLE 1. The resistance to oxidation is evaluated in the same manner as that of EXAMPLE 1.

EXAMPLE 12

A 34% solution of dispersant was produced by reacting 587 parts of the malei acid-added ethylene-propylene copolymer solution of EXAMPLE 1 with 252 parts of polypropylene alcohol having a ketimino group and molecular weight of 1600 (obtained by condensating monoethanolamine and methylisobutylketone and then random-adding 20 moles of propyleneoxide and 13 moles of ethyleneoxide to the resultant condensate) in 333 parts of xylene at 160° C. for 7 hours.

A polymer dispersion was produced in the same manner as that of the EXAMPLE 1 except using the thus obtained dispersant in place of the dispersant of EXAMPLE 1. The viscosity of the dispersion at 20° C. was shown in TABLE 1. The resistance to oxidation is evaluated in the same manner as that of EXAMPLE 1.

EXAMPLE 13

A 33% solution of dispersant was produced by condensating 243 parts of the ketimino group-having polypropyleneether alcohol of EXAMPLE 12 and 582 parts of the maleic acid-added ethlene-propylene copolymer (obtained by reacting 172 parts of ethylene-propylene copolymer having a weight average molecular weight of 20,000 with 5.2 parts of maleic anhydride) in the same manner as that of EXAMPLE 1.

A polymer dispersion was produced in the same manner as that of the EXAMPLE 1 except using the thus obtained dispersant in place of the dispersant of EXAMPLE 1. The viscosity of the dispersion at 20° C. was shown in TABLE 1. The resistance to oxidation is evaluated in the same manner as that of EXAMPLE 1.

EXAMPLE 14

A polymer dispersion was produced in the same manner as that of the EXAMPLE 1 except using the dispersant of EXAMPLE 7 in place of the dispersant of EXAMPLE 1 and using a mixture of di-sec-butylphenol and dibutyl phthalate in weight ratio of 1 to 1 in place of the medium of EXAMPLE 1. The viscosity of this dispersion at 20° C. was shown in TABLE 1. The resistance to oxidation is evaluated in the same manner as that of EXAMPLE 1.

EXAMPLE 15

A polymer dispersion was produced in the same manner as that of the EXAMPLE 1 except using the dispersant of EXAMPLE 7 in place of the dispersant of EXAMPLE 1 and using a mixture of di-sec-butylphenol, dibutyl phthalate and dihexyl phthalate in weight ratio of 5 to 3 to 2 in place of the medium of EXAMPLE 1. The viscosity of this dispersion at 20° C. is shown in TABLE 1. The resistance to oxidation was evaluated in the same manner as that of EXAMPLE 1.

EXAMPLE 16

A polymer dispersion was produced in the same manner as that of the EXAMPLE 1 except using the dispersant of EXAMPLE 7 in place of the dispersant of EXAMPLE 1 and using a mixture of di-sec-butylphenol and dibutyl adipate in weight ratio of 1 to 1 in place of the medium of EXAMPLE 1. The viscosity of this dispersion at 20° C. is shown in TABLE 1. The resistance to oxidation was evaluated in the same manner as that of EXAMPLE 1.

EXAMPLE 17

A polymer dispersion was produced in the same manner as that of the EXAMPLE 1 except using the dispersant of EXAMPLE 7 in place of the dispersant of EXAMPLE 1 and using a mixture of butyl salicylate and di sec-butylphenol in weight ratio of 1 to 1 in place of the medium of EXAMPLE 1. The viscosity of this dispersion at 20° C. is shown in TABLE 1. The resistance to oxidation was evaluated in the same manner as that of EXAMPLE 1.

EXAMPLE 18

A polymer dispersion was produced in the same manner as that of the EXAMPLE 1 except using the dispersant of EXAMPLE 7 in place of the dispersant of EXAMPLE 1 and using a mixture of di-sec-butylphenol, dibutyl phthalate and ethyleneoxide 4 mole-adduct of nonyl phenol in weight ratio of 4 to 5 to 1 in place of the medium of EXAMPLE 1. The viscosity of this dispersion at 20° C. was shown in TABLE 1. The resistance to oxidation is evaluated in the same manner as that of EXAMPLE 1.

EXAMPLE 19

A 34% solution of the dispersant was produced by reacting 1241 parts of the dispersant solution of EXAMPLE 1 with 30 parts of octylic acid and 1.3 parts of p-toluene sulfonic acid in 50 parts of xylene at 143° C.

for 10 hours. A polymer dispersion was produced by mixing a a solution of 130 parts of ethylene-propylene copolymer in 90 parts of normal paraffin having 10 carbon atoms with the above dispersant in amount containing 13.4 parts of an effective ingredient, 72 parts of di-sec-butyl phenol, 65 parts of dibutyl phthalate and 7.2 parts of calcium dodecyl benzene sulfonate at 130° C. while the total amount of normal paraffin was distilled off. A dispersion of the ethylene-propylene copolymer in the invention was obtained by cooling to 40° C. gradually with stirring. The viscosity of the dispersion at 20° C. was shown in TABLE 1. The resistance to oxidation was evaluated in the same manner as that of EXAMPLE 1.

COMPARISON 1

A polymer dispersion was produced in the same manner as that of the EXAMPLE 1 except using dibutyl phthalate alone in place of the medium of EXAMPLE 1. The viscosity of this dispersion at 20° C. is shown in TABLE 1. The resistance to oxidation was evaluated in the same manner as that of EXAMPLE 1.

COMPARISON 2

A polymer dispersion was produced in the same manner as that of the EXAMPLE 7 except using dibutyl phthalate only in place of the medium of EXAMPLE 7. The viscosity of this dispersion at 20° C. is shown in TABLE 1. The resistance to oxidation was evaluated in the same manner as that of EXAMPLE 1.

COMPARISON 3

A polymer dispersion was produced in the same manner as that of the EXAMPLE 9 except using dibutyl phthalate only in place of the medium of EXAMPLE 9. The viscosity of this dispersion at 20° C. is shown in TABLE 1. The resistance to oxidation was evaluated in the same manner as that of EXAMPLE 1.

COMPARISON 4

A polymer dispersion was produced in the same manner as that of the EXAMPLE 11 except using dibutyl phthalate only in place of the medium of EXAMPLE 11. The viscosity of this dispersion at 20° C. is shown in TABLE 1. The resistance to oxidation was evaluated in the same manner as that of EXAMPLE 1.

COMPARISON 5

A polymer dispersion was produced in the same manner as that of the EXAMPLE 13 except using dibutyl phthalate alone in place of the medium of EXAMPLE 13. The viscosity of this dispersion at 20° C. is shown in TABLE 1. The resistance to oxidation was evaluated in the same manner as that of EXAMPLE 1.

TABLE 1

| | Viscosity (cst) | Amount of Sludge (wt. %) |
|---|---|---|
| EXAMPLE | | |
| 1 | 1820 | 0.2 |
| 2 | 1640 | 0.3 |
| 3 | 2080 | 0.6 |
| 4 | 2450 | 0.7 |
| 5 | 1970 | 0.2 |
| 6 | 2130 | 0.3 |
| 7 | 1340 | 0.1 |
| 8 | 1570 | 0.2 |
| 9 | 3070 | 0.2 |
| 10 | 3110 | 0.3 |
| 11 | 3280 | 0.2 |

TABLE 1-continued

| | Viscosity (cst) | Amount of Sludge (wt. %) |
|---|---|---|
| 12 | 3080 | 0.4 |
| 13 | 2200 | 0.3 |
| 14 | 830 | 0.4 |
| 15 | 920 | 0.4 |
| 16 | 1750 | 0.5 |
| 17 | 1260 | 0.3 |
| 18 | 610 | 0.4 |
| 19 | 680 | 0.1 |
| COMPARISON | | |
| 1 | 2130 | 3.4 |
| 2 | 1940 | 3.8 |
| 3 | 3010 | 3.1 |
| 4 | 2850 | 3.6 |
| 5 | 3120 | 3.8 |

What is claimed is:

1. A polymer dispersion comprising:

(a) a polyolefin having a weight average molecular weight of 10,000 to 500,000;

(b) a dispersant comprising a reaction product of an ethylenically unsaturated dicarboxylic acid-added polyolefin with a carboxylic acid-reactive compound selected from the group consisting of an amine, a ketimine compound, an alcohol and an isocyanate compound, said reaction product having an amide linkage, an imide linkage or an ester linkage, and (c) a phenolic derivative selected from the group consisting of an alkyl salicylate, phenol having one alkyl group of 1 to 20 carbon atoms and phenol having two alkyl groups of 1 to 20 carbon atoms.

2. An improver according to claim 1, wherein the polyolefin is an ethylene-propylene copolymer or a polyolefin containing 0.5 to 3% by weight of a basic nitrogen atom.

3. An improver according to claim 1, wherein the medium contains not less than 30% by weight of the phenolic derivative.

4. An improver according to claim 1, which contains 20 to 60% by weight of the polyolefin.

5. An improver according to claim 1, which contains 0.5 to 20% by weight of the dispersant.

6. An improver according to claim 1, which contains 30 to 70% by weight of the medium.

7. An improver according to claim 1, wherein the weight ratio of the unsaturated dicarboxylic acid-added polyolefin to the carboxylic acid-reactive compound is in the range of from 20:80 to 80:20.

8. An improver according to claim 1, wherein the reaction product has an oxyalkylene structure.

9. An improver according to claim 1, wherein the carboxylic acid-reactive compound is a polyoxyalkylene alcohol having an amino group or a ketimino group.

10. An improver according to claim 9, wherein the polyoxyalkylene alcohol has a number average molecular weight of 1,000 to 4,000.

11. An improver according to claim 1, wherein the unsaturated dicarboxylic acid-added polyolefin has a backbone composed of the same olefinic monomer unit as the polyolefin having a weight average molecular weight of 10,000 to 500,000.

12. An improver according to claim 1, wherein the alkyl group in the phenolic derivative contains 4 to 12 carbon atoms.

13. An improver according to claim 1, wherein the alkyl phenol is di-sec-butylphenol.

14. An improver according to claim 1, wherein the medium further contains a carboxylate ester or an alkyleneoxide adduct of an alkyl phenol.

15. An improver according to claim 14, wherein said ester is a diester of a dicarboxylic acid and a monohydric alcohol having 1 to 10 carbon atoms.

16. An improver according to claim 1, wherein the ethylenically unsaturated dicarboxylic acid is maleic acid, itaconic acid, chloromaleic acid, an anhydride thereof, a halide thereof, a monoester thereof or a monoamide thereof, fumaric acid, a fumaryl halide, a fumarate monoester or a fumarmonoamide.

17. An improver according to claim 1, wherein the amount of the unsaturated dicarboxylic acid-added polyolefin is a polyolefin to which an unsaturated dicarboxylic acid has been added in the range of 10 to 250 moles per mole thereof.

18. An improver according to claim 1, which further contains a mono-or dialkyl benzene sulfonate salt.

19. An improver according to claim 1, wherein the reaction product is an ester of an aliphatic carboxylic acid and a hydroxy terminated compound derived from the unsaturated dicarboxylic acid-added polyolefin and the the polyoxyalkylene alcohol having an amino group or a ketimino group.

* * * * *